United States Patent [19]

Poock

[11] 4,352,434

[45] Oct. 5, 1982

[54] PENDANT SUPPORTED HYDRAULIC EXTENSIBLE BOOM

[75] Inventor: Darwin N. Poock, Cedar Rapids, Iowa

[73] Assignee: FMC Corporation, Chicago, Ill.

[21] Appl. No.: 145,529

[22] Filed: May 1, 1980

[51] Int. Cl.[3] ..... B66C 23/00

[52] U.S. Cl. ..... 212/186; 212/187; 212/230; 212/231; 212/267; 212/268; 212/264; 52/116

[58] Field of Search ..... 212/149, 151, 152, 153, 212/157, 183, 201, 240, 260, 262, 264, 265, 230, 231, 237, 239, 184–188, 267, 268; 52/116, 118, 119, 632; 414/718

[56] References Cited

U.S. PATENT DOCUMENTS

| | | | |
|---|---|---|---|
| 1,632,329 | 6/1927 | Hake . | |
| 1,869,747 | 8/1932 | Howard . | |
| 1,871,603 | 8/1932 | Ginter | 212/262 |
| 2,475,963 | 6/1949 | Howell . | |
| 2,819,803 | 1/1958 | Obenchain . | |
| 2,868,392 | 1/1959 | Poffenberger . | |
| 3,194,413 | 7/1965 | Landry . | |
| 3,308,967 | 3/1967 | Barkley et al. . | |
| 3,371,799 | 3/1968 | Brownell et al. . | |
| 3,426,917 | 2/1969 | Siegel . | |
| 3,465,899 | 9/1969 | Reuter et al. . | |
| 3,534,867 | 10/1970 | Johnston et al. | 212/264 |
| 3,648,850 | 3/1972 | Rochon et al. . | |
| 3,727,359 | 4/1973 | Vonck . | |
| 3,856,151 | 12/1974 | Lamer . | |
| 3,918,592 | 11/1975 | Paul . | |
| 4,011,699 | 3/1977 | Mickelsen . | |
| 4,049,238 | 9/1977 | Brown . | |
| 4,053,058 | 10/1977 | Jensen et al. . | |
| 4,166,542 | 9/1979 | Bryan, Jr. . | |

*Primary Examiner*—H. Grant Skaggs

*Attorney, Agent, or Firm*—A. J. Moore; R. B. Megley

[57] ABSTRACT

A crane with a telescopic extensible boom is disclosed. Two cylinders within the boom are each connected between adjacent sections for relative movement between the sections. Pendants are trained over sheaves on a live mast, and one end of the pendants is held by a stop on the mast. The other end of the pendants is received in the boom over sheaves mounted in fixed relation to the respective crane sections. The opposite end of the pendants is connected to the base section of the boom.

15 Claims, 18 Drawing Figures

PENDANT SUPPORTED HYDRAULIC EXTENSIBLE BOOM

BACKGROUND OF THE INVENTION

1. Field of the Invention

The present invention relates to a crane having a non-cantilevered hydraulic extensible boom, and, more specifically, relates to a crane having a pendant supported hydraulic extensible boom.

2. Description of the Prior Art

It is known, as shown in the U.S. Pat. No. 4,053,058 (Jensen and Powers, Oct. 11, 1977) to provide a crane with a telescopic boom which is extended by cables and which is supported from a live mast by a pendant line.

It is also known to provide a crane with a cantilevered, telescopic boom, the sections of which are extended and retracted hydraulically, as shown, for example, in the U.S. Pat. No. 4,011,699 (Mickelson, Mar. 15, 1977). In the U.S. Pat. No. 3,856,151 (Lamer, Dec. 24, 1974), a cable is provided on a cantilevered, hydraulically operated telescopic boom to support a jib extension.

Yet other patents have combined the feature of hydraulic extension and retraction with a cable support of the boom (U.S. Pat. No. 3,371,799 of Brownell et al, Mar. 5, 1968; U.S. Pat. No. 2,868,392 of Poffenberger, Jan. 13, 1959; and U.S. Pat. No. 2,475,963 of R. C. Howell, July 12, 1949). In the patents U.S. Pat. No. 3,371,799; U.S. Pat. No. 2,868,392; and U.S. Pat. No. 2,475,963 the length of the boom supporting cable, or the elevation of the boom, is materially altered as the boom is extended or retracted, to accommodate the change in length of the boom.

U.S. Pat. No. 3,308,967 which issued to Barkley on Mar. 14, 1967, discloses a telescopic boom pivoted at its rear end having a live mast pivoted to the boom and substantially normal thereto. A fixed length pendant is secured at one end to the forward end of the tip section while the other end of the pendant is secured to the rear end of the tip section. The pendant is trained around a plurality of sheaves within the boom, around a sheave on the top of the mast, and is wrapped around a pair of driven wheels which provide the sole source for extending and retracting the boom. The boom is raised and lowered by a winch which drives a line connected to the upper end of a mast; and the mast may be pivoted intermediate its ends for reducing the height of the crane.

SUMMARY OF THE INVENTION

The present invention relates to a crane having an extensible boom with a plurality of telescopic boom sections, wherein the improvement comprises a mast, a pendant extending from the mast to and into the extensible boom for connection to one of said boom sections, sheaves to receive the pendant mounted in the boom in fixed relation, respectively, to different boom sections, at least one hydraulic cylinder in the boom to extend the boom for relative movement of the sheaves with respect to each other to pay out the pendant from the boom, and power means to exert tension on the pendant to elevate the boom.

DESCRIPTION OF THE PREFERRED EMBODIMENTS

Figure 1:
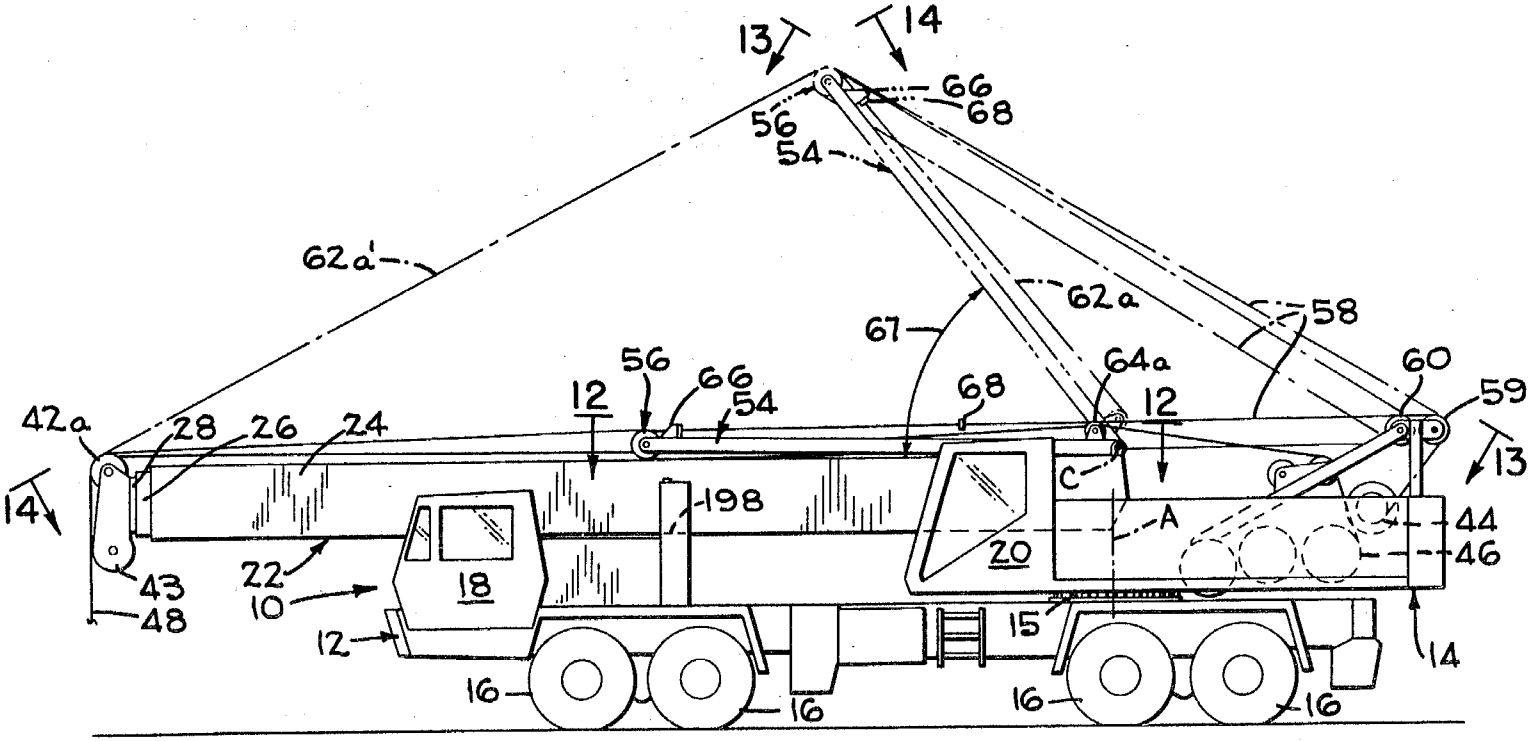
FIG. 1 is a side view of a machine incorporating the pendant supported hydraulic extensible boom of the present invention.

There is shown in FIG. 1 a truck crane 10 having a self-propelled lower works, or chassis, 12 and an upper works 14. The lower works 12 has ground engaging wheels 16 and a cab 18 for the driver of the truck crane. The upper works 14, which is mounted on the lower works by means of a swing bearing 15, is rotatable about a vertical axis A on the lower works. The upper works 14 has a cab 20 for the crane operator, and has a boom 22 mounted thereon.

Figures 2, 6:
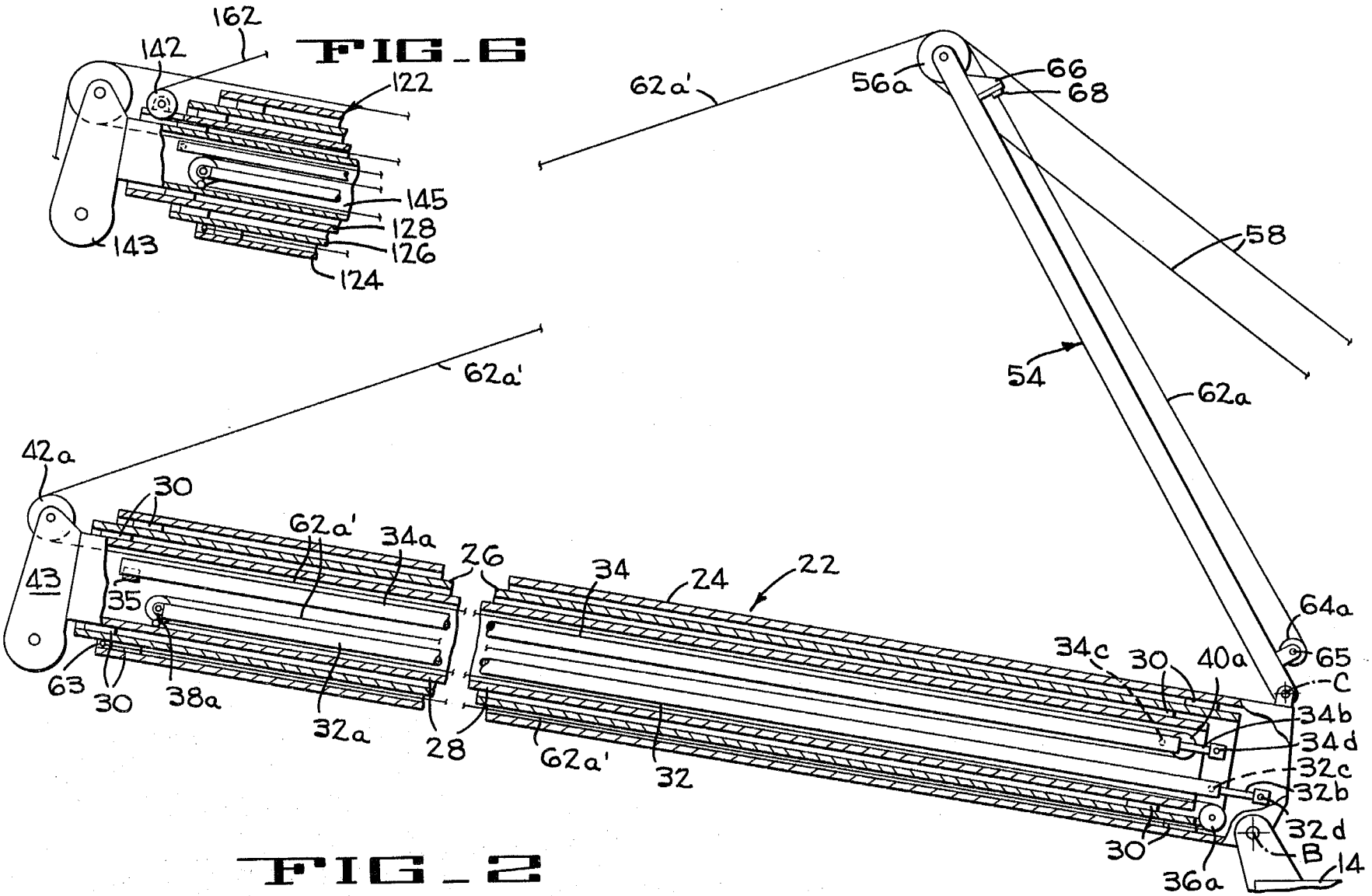
FIG. 2 is an enlarged view of the boom of FIG. 1 in a retracted mode.
FIG. 6 is a fragmentary view of a machine with a four-section boom.
Figure 3:
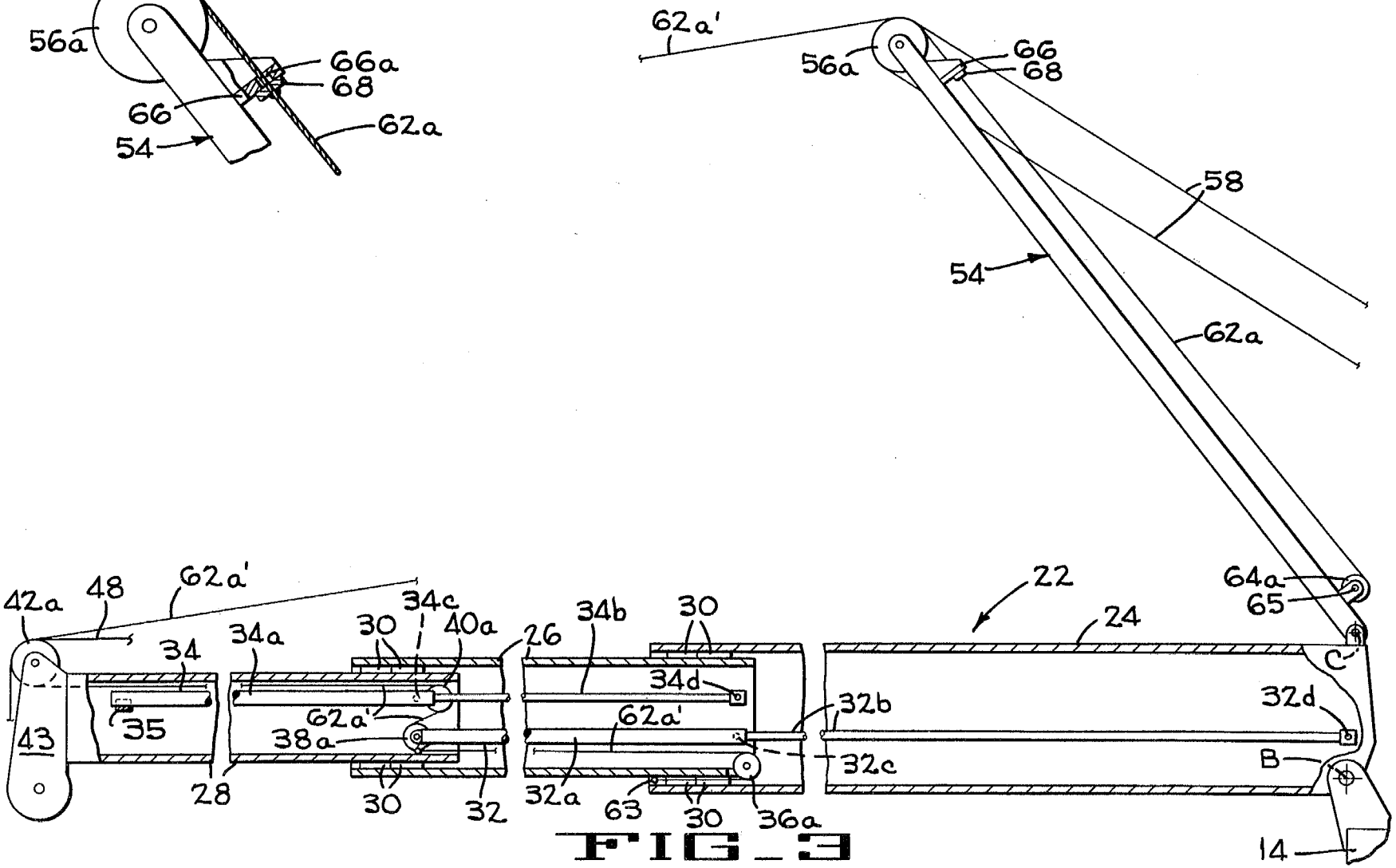
FIG. 3 is a view taken as the view of FIG. 2 showing the boom in an extended mode.

The boom 22, as shown best in FIGS. 2 and 3, has a base section 24 mounted at one end on the upper works 14 for pivoting in a vertical plane about a horizontal axis B. A mid, or intermediate, section 26 is slidably received in the base section 24, and a tip section 28 is slidably received in the intermediate section 26. Supporting members, or pads, 30 (some of which are omitted for clarity) are received between adjacent telescoped boom sections (and connected to one of them) to separate the boom sections and permit relative longitudinal movement therebetween.

Relative longitudinal movement between the three boom sections is accomplished by two rams: a lower ram 32 and an upper ram 34. Ram 32 has a cylinder **32*a* and a piston (not shown) slidably received therein which is connected to a rod 32*b*. The rear, or base end, of cylinder 32*a* is connected at 32*c* to the rear end of the boom midsection 26; and the rear end of rod 32*b* is connected at 32*d* to the rear end of the boom base section 24. Thus, when the ram 32 is retracted, as shown in FIG. 2, the intermediate section 26 is retracted with respect to the base section 24. When the ram 32 is extended as shown in FIG. 3, the intermediate section 26 is extended with respect to the base section 24**, as shown in FIG. 3.

Ram 34 has a cylinder 34*a* and a rod 34*b*. The rear end of cylinder 34*a* is connected at 34*c* to the rear end of the boom tip section 28. The forward end of the ram 34 slidably rests on a bracket 35 or the like which supports the weight of the forward portions of the ram normal to its axis but provides no significant resistance to axial forces applied to that end of the ram 34. The rear end of rod 34*b* is connected, at 34*d*, to the rear end of the boom midsection 26. Thus, when ram 34 is retracted, as shown in FIG. 2, the tip section 28 is retracted with respect to the midsection 26. When the ram 34 is extended, as shown in FIG. 3, the tip section is extended with respect to the midsection 26.

Figure 14:
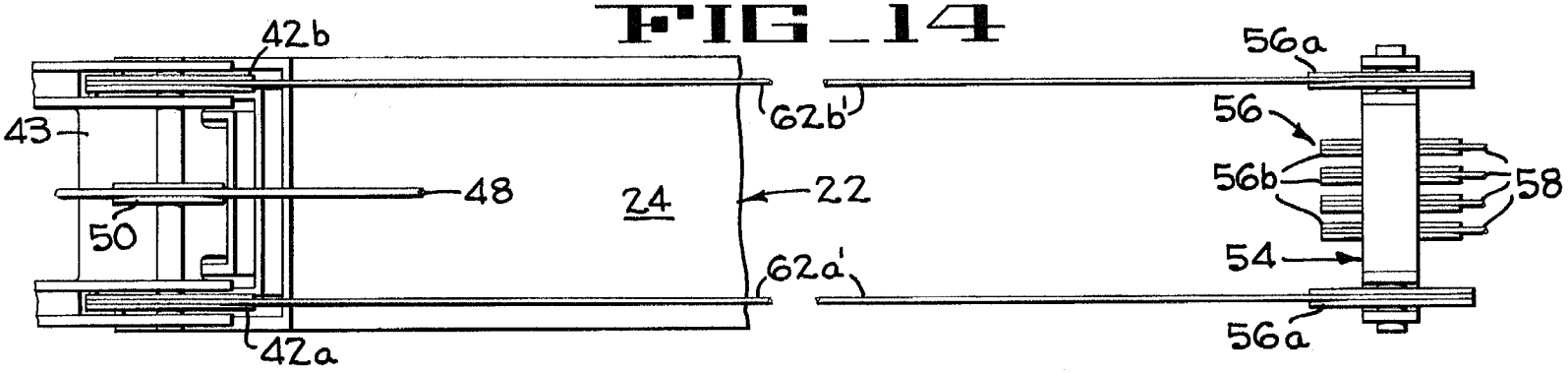

A pair of pendant line sheaves (only one sheave 36*a* being shown in FIGS. 2 and 3) are mounted on the rear end of the boom midsection 26; a pair of pendant line sheaves (only one sheave 38*a* being shown) are mounted on the front end of lower cylinder 32*a*; a pair of pendant line sheaves (only one sheave 40*a* being shown) are mounted to the rear end of the boom tip section 28; and a pair of pendant line sheaves 42*a*, 42*b* (FIG. 14) are mounted to the head 43 on the front end of the boom tip section 28.

Figure 7:
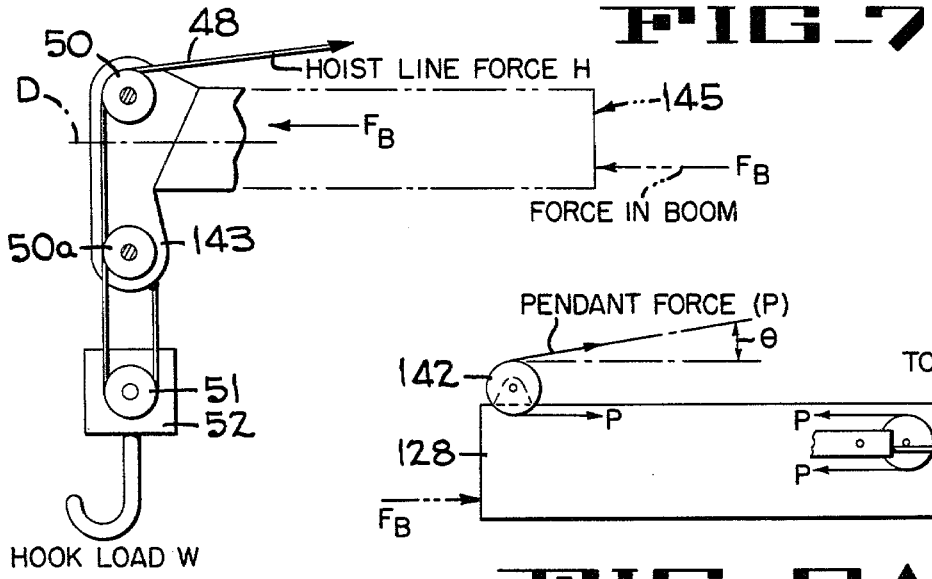
FIGS. 7 and 8A are diagrammatic sketches of forces on a section of the boom of FIG. 6.

Mounted on the upper works 14 (FIGS. 1 and 4) of the crane are several power rotated drums including a boom hoist drum 44 and a load hoist drum 46. A load hoist line 48 is received on the load hoist drum 46 and passes over idler sheave 50 (FIG. 14) and load hoist sheave (FIG. 7) in the head at the front of the tip section, and over sheave 51 in load block 52 (FIG. 7). The outer end of load hoist line 48 is connected to head 43 (FIGS. 1 or 4) or to four section boom head 143 as illustrated in FIG. 7.

Figure 12:
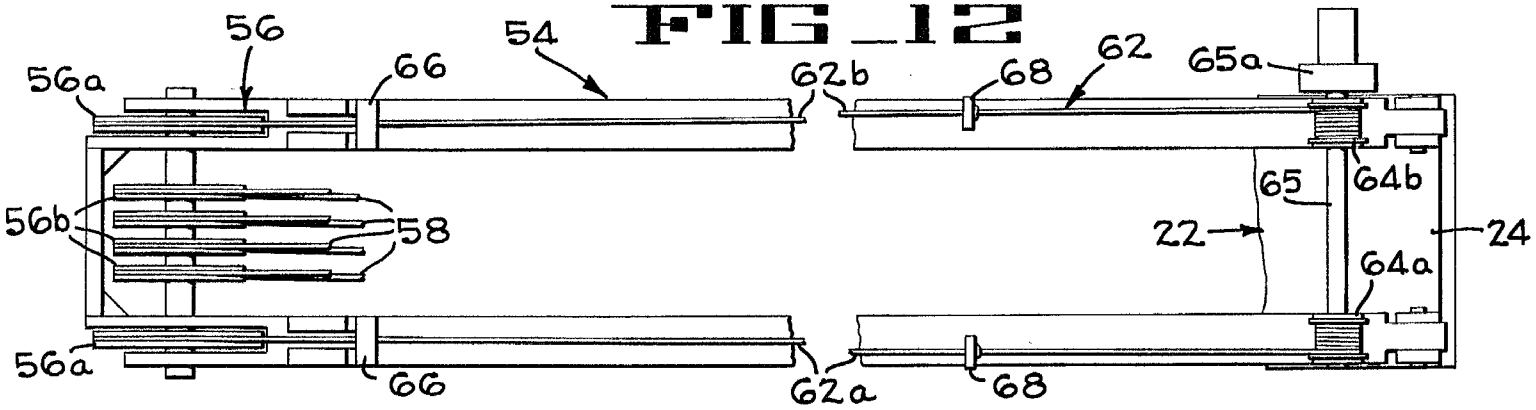
FIGS. 12, 13 and 14 are views taken, respectively, on the lines 12—12, 13—13 and 14—14 of FIG. 1.
Figure 13:
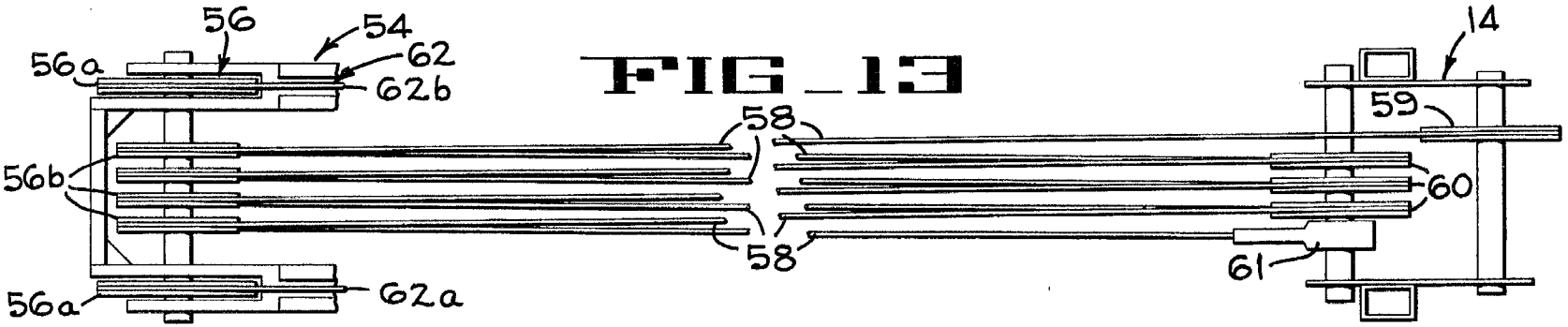

A live mast 54 is pivotally connected at one end to the rear of the boom base section 24, as shown best in FIGS. 2 and 3, for pivotal movement in a vertical plane about a horizontal axis C. The mast 54 is pivoted between a lowered transport position that is substantially parallel to the longitudinal axis of the boom 22 as shown in solid lines in FIG. 1, and a raised boom supporting position as shown in phantom lines in FIG. 1. The live mast has, at its upper end, a plurality of sheaves 56 (FIGS. 12 and 13) which include pendant line sheaves 56*a* and boom hoist sheaves 56*b*.

A boom hoist line 58 extends from the boom hoist drum 44 over a defector sheave 59 (FIG. 13) and then alternately over boom hoist sheaves 56*b* on the upper end of the live mast 54, back to boom hoist sheaves 60 on the upper works 14 of the crane. The outer end of boom hoist line 58 deadends at 61 adjacent pulleys 60.

A pendant 62 (FIG. 12) consists of a pair of pendant lines (62*a*, 62*b*) extending from pendant line take-up and payout drums 64*a*, 64*b* which are mounted on shaft 65 on the lower end of the live mast 54. Shaft 65 is connected to a hydraulic motor 65*a* which receives fluid under pressure to apply a biasing torque to shaft 65 in a direction to wind up pendants 62*a* and 62*b* on drums 64*a*, 64*b*. When the live mast is raised, the force on the pendants overcomes the bias to payout the pendants from the drums.

Figure 5:
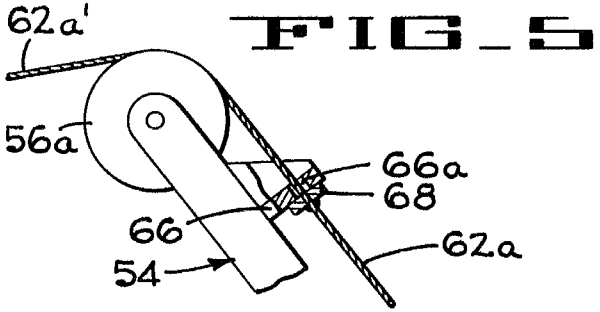
FIG. 5 is an enlarged fragmentary view of the top of the mast of the machine of FIG. 1.

As shown in FIG. 5, each pendant line passes through openings 66*a* in a stop 66, and passes over the associated pendant line sheaves 56*a*, 56*b* at the top of the live mast. A pendant stop plate or anchor 68 is secured on each pendant line below the stop 66, and engages the stop when the live mast is raised from the stored position on the upper works (shown in solid lines in FIG. 1) to an operating position (shown in phantom lines in FIG. 1). To raise and lower the live mast during normal operation, the live mast is swung through an operating range (illustrated by arrow 67 in FIGS. 1 and 4 by the powered boom hoist drum 44).

The pendant line 62*a* extends from pendant line sheave 56*a* to pendant line sheaves 42*a*, 40*a*, 38*a* and 36*a* as shown, for example, in FIG. 3. The pendant line 62*a* is secured at 63 to the front end of the base section 24. Pendant line 62*b* is trained around corresponding sheaves (not shown).

Since one end of each pendant 62 is anchored at 63, and since each pendant stop plate 68 engages the stop 66 when the mast is raised to the boom supporting position shown in phantom lines in FIG. 1 (the extreme right-hand operating position as viewed in that Figure) the boom supporting portions 62*a*′ between stop plate 68 and anchor point 63 of line 62*a* (and the corresponding portion 62*b*′ of line 62*b*) define fixed length pendants which raise and lower the boom in accordance with the angular position of the live mast 54.

A comparison of FIGS. 2 and 3 will give an indication of the amount of the fixed length pendant line portions 62*a*′ and 62*b*′ payed out of the boom when the boom is extended from its minimum length to its maximum length. In the fully retracted position shown in FIG. 2 (with both rams retracted), an extent of line 62*a* equivalent to approximately double the sum of the length of the two rams 32 and 34 is stored in the boom. When the boom is in the fully extended position (by full power extension of the two hydraulic rams) shown in FIG. 3, about half of the initially stored portion of line 62*a* has been payed out to accommodate the difference in length of the boom. Thus, the boom will remain at generally the same angle during boom extension or retraction.

The same pendant support system can be utilized on a four section boom 122 (FIG. 6) as is utilized on the three section boom 22. Boom 122 has a base section 124, an intermediate section 126 and a tip section 128. These components are similar to the corresponding sections of boom 122 except that tip section 128 is open at its outer end and a head 143 is mounted on a manual boom section 145 which is received in the tip section 128. The pendant lines 162 are received over pendant sheaves 142 mounted on the outer end of the tip section instead of the head, and the pendant lines are reeved within the boom sections in the same manner as in boom 22.

There are, in FIGS. 7 to 10, diagrams showing forces in the boom sections acting axially (along central boom axis D). The sections in the diagrams are shown horizontally, but are intended to represent the sections regardless of the angle of the boom to the horizontal. In none of the diagrams is the weight of the boom sections considered.

Figures 4, 8B:
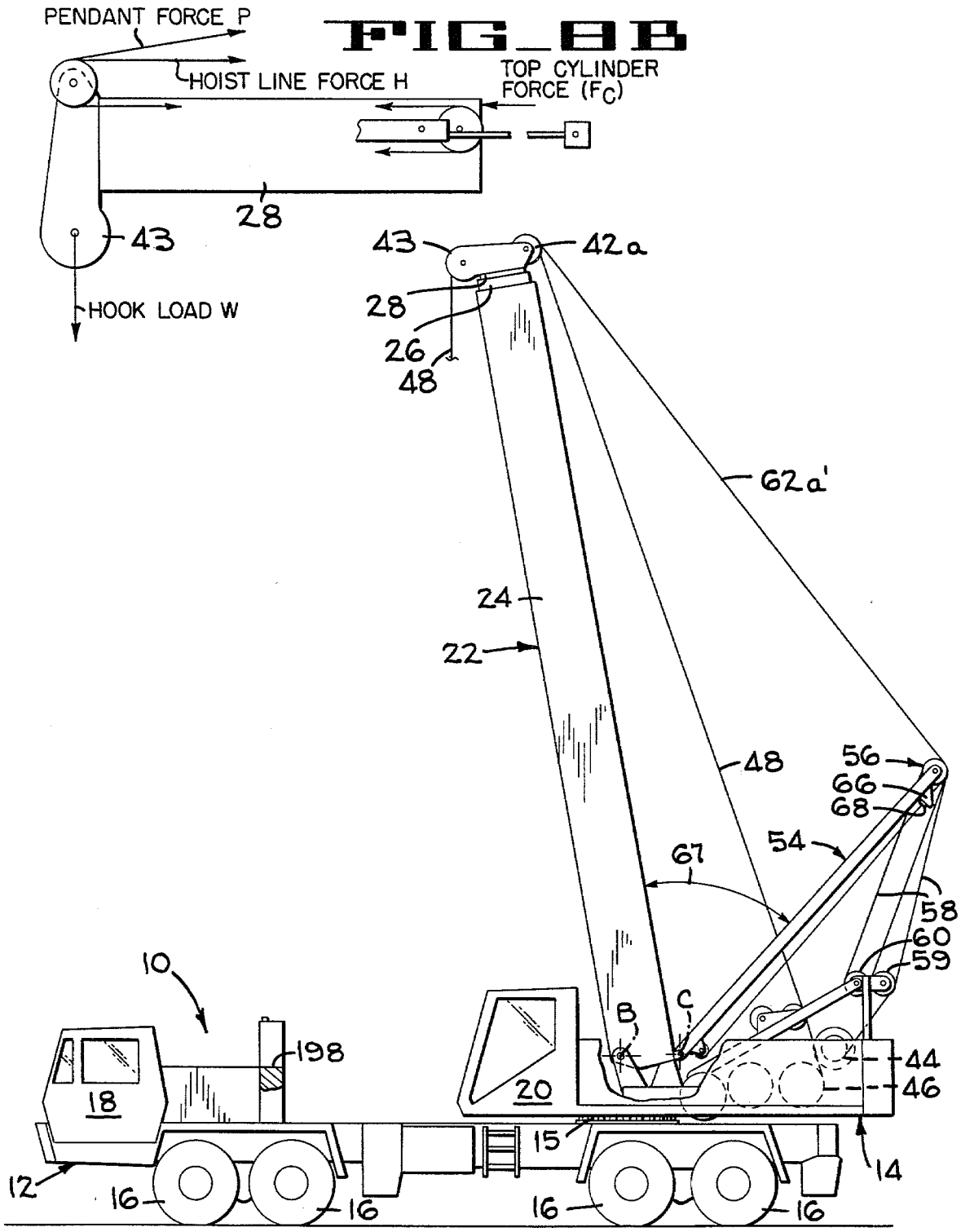
FIG. 4 is a view of the machine of FIG. 1 showing the boom in a raised position.
FIG. 8B is a diagrammatic sketch of forces on a section of the boom of FIG. 1.
Figure 8A:
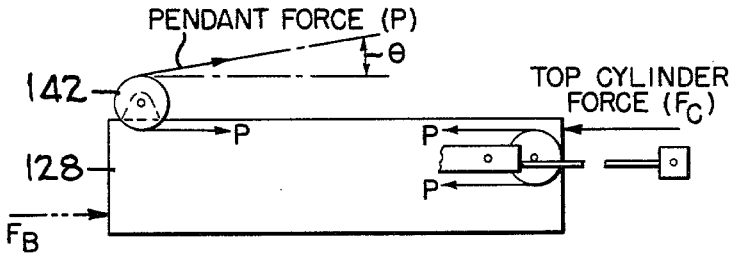
Figure 9:
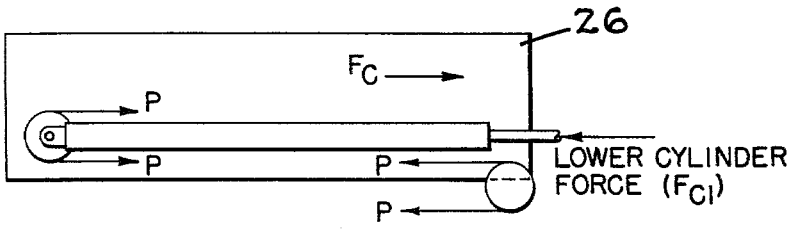
FIGS. 9 and 10 are diagrammatic sketches of forces on sections of the booms of FIGS. 1 and 6.

The forces in manual section 145 of a four section boom are shown in FIG. 7; and the forces on the tip section 128 of a four section boom are shown in FIG. 8A. The forces on the tip section 28 of a three section boom are shown in FIG. 8B. As will be noted from FIGS. 8B and 7, the head section may be a rigid part of the tip section 28, or may be a rigid part of a separate manual section 145.

In the four section boom (FIG. 7), the force on the manual section 145 will be, at any angle and at any hook load, a hoist line force which I will designate H, and a component of the hook load W, ($W_{sin}$ (boom angle)). This force will be resisted by a force $F_B$ exerted between the tip section 128 (FIG. 6) and the manual section 145. Thus, $F_B = H + W_{sin}$ (boom angle). In the four section boom, the axial forces on the tip section (FIG 8A) which equal zero, are $F_B + P_{cos}\,\theta + P - F_c - 2P = 0$, where $F_c$ represents the axial force between the boom tip section and the intermediate section of the boom.

With either a three section boom or a four section boom, the force $F_B$ would be the same, and would be of a magnitude to equal the axial component of force H of the hoist line 48, plus the axial component of the weight of the hook load W (at any angle of the boom). It should be noted that the force $F_B$ acts on the front of the tip section 28, regardless of whether the head is mounted to the tip section or to the manual section 70.

In a three section boom, the axial forces acting on the tip section 28 are as shown in FIG. 8B, where the hoist line generates an axial force H and the hook load generates an axial force $W_{sin}$ (boom angle) (which I have previously equated to a boom force $F_B$ at any angle and any hook load). Since the sum of the axial forces on the boom section equals zero, $$F_B + P_{cos}\,\theta + P = P + P + F_c$$

where $F_c$ represents the axial force between the tip section and the intermediate section. Simplifying the above equation (which is identical to the corresponding equation for the four boom section)

$$F_c = F_B + P_{cos}\,\theta - P$$

In either the three section or four section boom (see FIG. 9), the axial forces acting on the intermediate boom section 26 (which also total zero) are as follows:

$$F_c + 2P = 2P + F_{c1}$$

whereas $$F_c = F_{c1}$$

Figure 10:
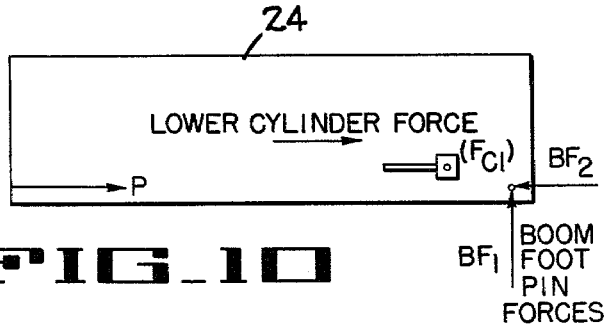

The forces on the base section 24 (in either the three section boom or the four section boom) are shown in FIG. 10. From the diagram, it will be seen that $$P + F_{c1} = BF_2$$

if the boom weight is neglected. In any event, and at any angle of the boom, the axial boom foot force $BF_2$ will match the forces $P + F_{c1}$.

Figure 11:
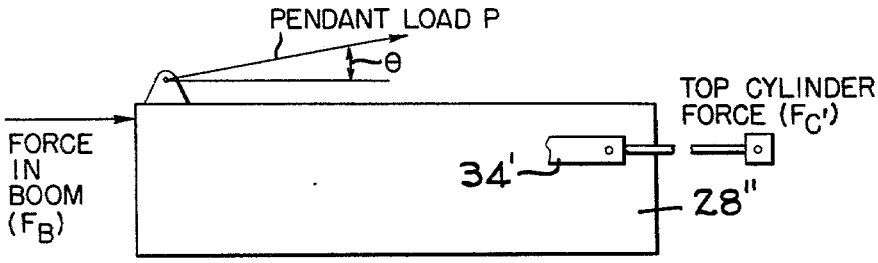
FIG. 11 is a diagram of forces on a different boom section not constructed in accordance with the present invention.

The advantage of a pendant line stored on sheaves in the boom can be appreciated by a consideration of the diagram of FIG. 11. In a system identical to the system of FIGS. 1 to 10, except that the pendant is tied to the end of the tip section 28'', the axial forces on the tip section, which must equal zero, can be expressed as follows:

$$F_c' = F_B + P_{cos}\,\theta$$

It will be noted that the force $F_c'$ in the top cylinder 34' is greater by the amount P than the corresponding force $F_c$ which is the top cylinder force when the pendant is stored on sheaves in the boom. In both cases, the weight of the boom sections (which would be substantially the same) has been ignored.

Thus, it is apparent that the axial loads acting on the hydraulic cylinders of the pendant supported hydraulic extensible boom of the present invention is significantly less than the axial forces acting upon the cylinders of the type of boom discussed in connection with FIG. 11. Accordingly, the use of the pendant to aid boom extension makes it possible to use smaller cylinders than would be required if the pendant assist was not provided.

It is apparent that pendant 62 will become slack when the live mast 54 is moved between its stowed or transport position illustrated in solid lines in FIG. 1 and its raised working position illustrated in phantom lines in FIG. 1, unless the two take-up and payout pendant line drums **64*a* and 64*b* (FIGS. 12 and 17) maintain the take-up portions 62*a*'' and 62*b*'' of the two pendant lines 62*a* and 62*b* tensioned. A hydraulic and electrical circuit 168 illustrated in FIG. 17 performs this tensioning function with the aid of a preferred form of pendant stop plates or anchors 68' illustrated in FIGS. 15 and 16. Only the anchor 68' illustrated with pendant line 62*a* is shown in FIGS. 15–17**.

Figure 15:
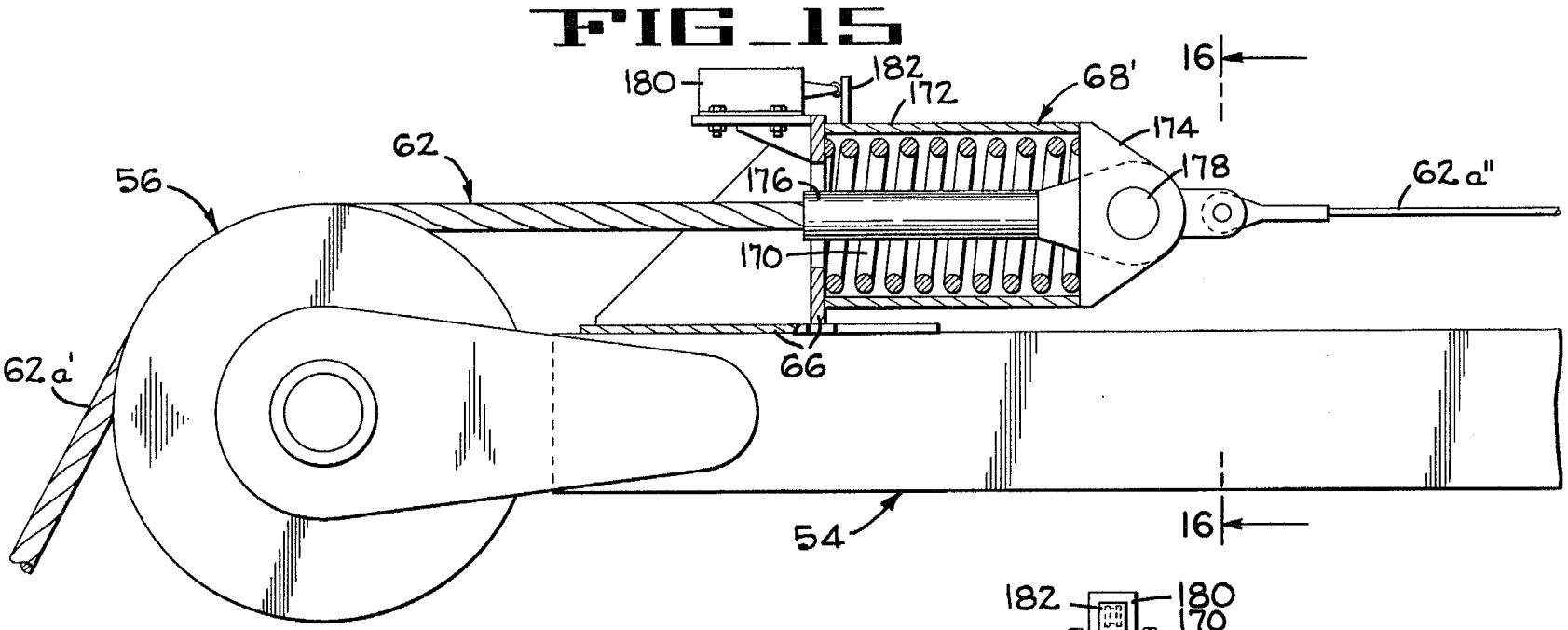
FIG. 15 is an enlarged view of the upper end of the live mast similar to FIG. 5 but illustrating a preferred form of the pendant stop plate or anchor partially shown in vertical central and in switch actuating position.
Figure 16:
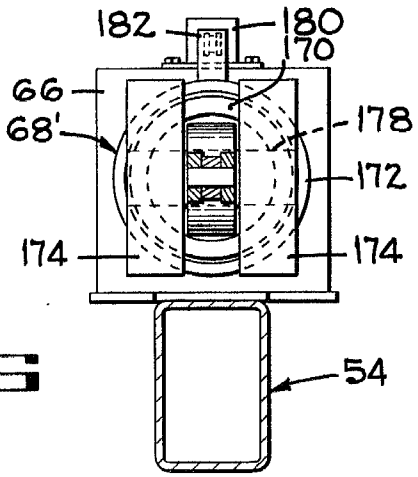
FIG. 16 is a vertical section taken along lines 16—16 of FIG. 15.

As illustrated in FIGS. 15 and 16, boom supporting pressure is applied to pendant line portion **62*a*' thereby compressing a spring 170 between pendant stop 66 and pendant anchor 68'. The pendant anchor 68' includes a spring housing 172 which has one end abutting the stop 66 and the other end secured to a pair of ears 174. The ears receive a cable connetor 176 and a pin 178 thereby securing one end of the pendant 62*a*' to the anchor 68'. The pendant take-up line 62*a*'' is illustrated as being connected to and of smaller diameter than the boom supporting portion 62*a*'. It will be understood that the take-up line 62*a*'', and a similar line 62*b*'' associated with the pendant 62*b*, are trained around the drums 62*a* and 62*b* (FIG. 17), respectively. A spring loaded pendant switch 180 is supported by the pendant stop 66 and is opened by a switch actuating element 182 when the pendant anchor 68 is in abutting contact with the stop 66 as indicated in FIGS. 15 and 17. When insufficient force is applied to the live mast 54 by the boom hoist drum 44 (FIG. 1), the spring 170 exerts sufficient force to move the housing 172 away from the stop 66 thus allowing the switch 180** to close.

Figure 17:
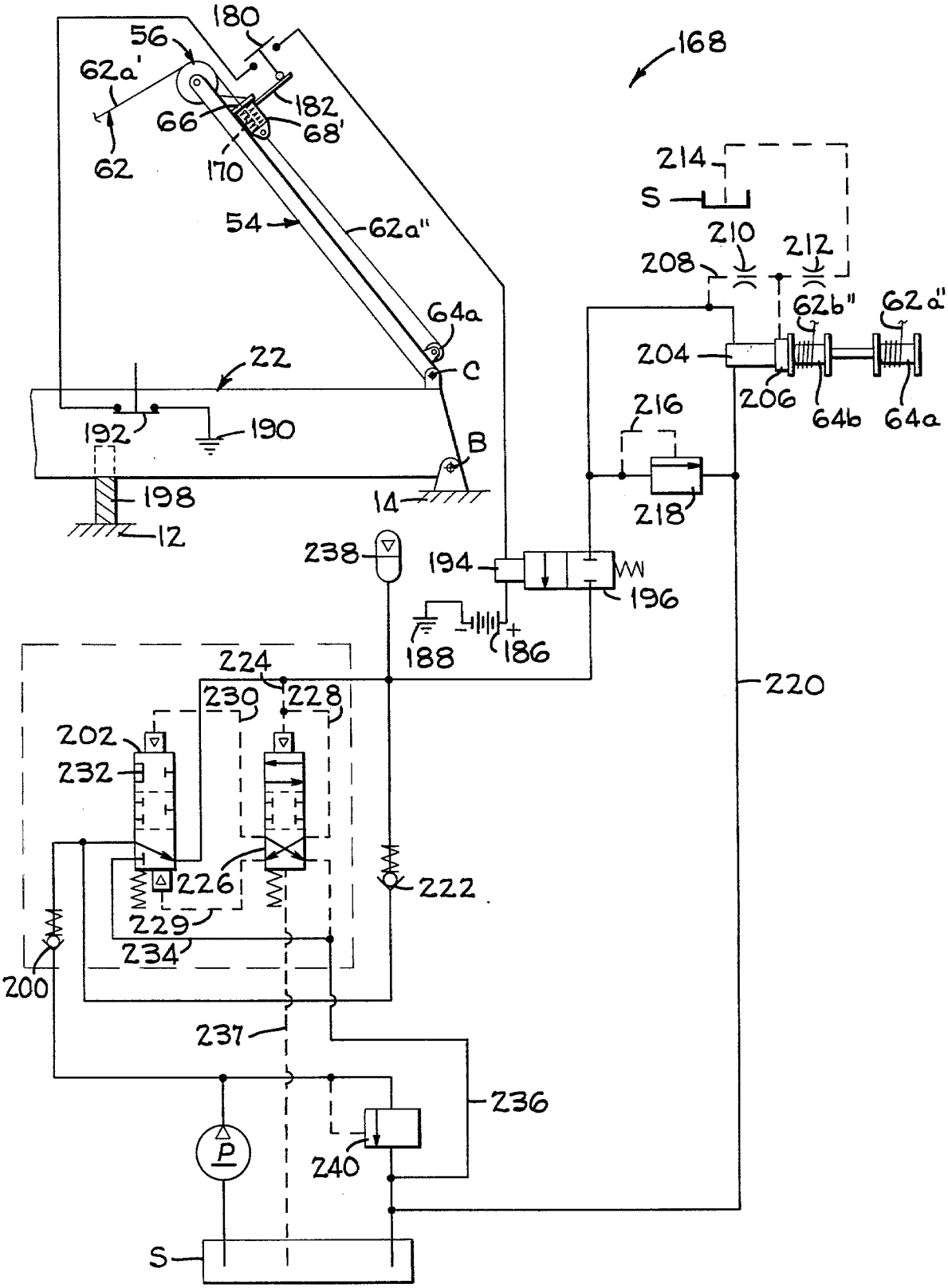
FIG. 17 is a diagrammatic hydraulic and electrical circuit for controlling the actuation of the pendant line take-up and payout drums.

Having reference to FIG. 17, the electrical portion of the circuit 168 receives its power from a battery 186 which is grounded at 188; and also at 190 when pendant switch 180 and live mast switch 192 are both closed which occurs when the live mast 54 is moving between its illustrated raised position and its transport position substantially parallel with the boom 22. When both switches 180 and 192 are closed, solenoid 194 of solenoid valve 196 is shifted to its open position.

The hydraulic portion of the circuit 168 will be described along with the pendant take-up and payout operation. It will be understood that the components as illustrated in FIG. 17 are as they would appear when the live mast 54 is supported by the boom hoist drum 44 (FIG. 1) and when the drum 44 is applying sufficient force through lines 58 to compress the pendant anchor spring 170 (FIG. 15) but with the boom 22 already in transport position resting on a boom stop 198.

In order to lower the live mast 54 to its stowed or transport position, the operator actuates conventional controls (not shown) to drive the boom hoist drum 44 in mast lowering direction thereby reducing tension on the pendant lines 62 which permits spring 170 to move anchor 68' away from the stop 66 thus allowing pendant switch 180 to close. Closing of pendant switch 180 energizes solenoid 194 opening valve 196.

Hydraulic fluid is then drawn from sump S by pump P which directs the fluid through; check valve 200, unloading valve 202, solenoid 196, and into and through hydraulic motor 204 to drive the drums 64*a* and 64*b* in a direction which will take up slack and maintain tension on the pendant lines 62*a*'' and 62*b*''. The hydraulic motor 204 will not rotate the drums until hydraulic pressure is sufficient to release a spring set—hydraulic release brake 206.

The brake releasing fluid flows through pilot lines 208 and through flow control valve 210 and 212 before returning to the sump S at 214. If the pressure directed to the hydraulic motor 204 becomes excessive, pressure in a pilot line 216 opens pilot operated relief valve 218 allowing hydraulic fluid to return to the sump S through line 220.

When the live mast 54 reaches its horizontal transport position, it opens a spring loaded switch 192 thereby breaking the circuit to solenoid 194 thus closing solenoid valve 196 stopping flow of fluid to the hydraulic motor 204. Accordingly, the pressure to the brake 206 is reduced allowing the spring to set or engage the brake thereby locking the drums 64*a* and 64*b* in position to maintain tension on the pendant lines when the live mast is in its transport position.

With solenoid valve 196 closed and a check valve 222 blocking return of high pressure fluid to the sump S, pilot pressure is directed through line 224 thereby shifting a spring return unloading valve 226 from the illustrated cross-passage position (which directs pilot pressure through lines 228 and 229 to the lower end of valve 202) to its parallel passage position. Pilot pressure then flows through pilot lines 228 and 230 to the top of unloading valve 202 shifting its core downwardly against the urging of a spring causing high pressure fluid from pump P to flow through a U-shaped passage 232 in valve 202 and back to the sump S through lines 234 and 236. A conduit 237 is provided to drain fluid from the lower end of valve 226.

The hydraulic circuit also includes the usual accumulator 238, and a pressure relief valve 240 which bypasses hydraulic fluid directly from the pump P to the sump S if excessive pressure build-up occurs.

When it is desired to raise the live mast 54 from its lowered transport position to its raised operative position as illustrated in FIG. 17, the operator actuates conventional controls to drive the boom hoist drum 44 (FIG. 1) in a direction which will raise the live mast 54.

Spring loaded mast switch 192 closes in response to initial upward movement of the mast. Closing of switch 192 establishes a circuit to solenoid 194 through closed switch 180 thereby energizing solenoid 194 and opening solenoid valve 196. Hydraulic fluid then flows through previously described circuits to release the brake 206 in a direction which tends to drive the hydraulic motor 204 in a pendant take-up direction as previously described. However, when the mast 54 is being pivoted upwardly it is apparent that the pendant should be paid out, not taken up, by the drums 64*a* and 64*b*.

It will be understood that force applied by the boom hoist 44 to raise the mast and to eventually support the boom 22 and its load, is considerably greater than the force applied by the hydraulic motor 204 to the drums 64*a* and 64*b*. Thus, raising of the mast 54 will reverse the direction of rotation of the hydraulic motor 204 causing it to act as a pump. Accordingly, the pressure will build up in pilot line 216 in excess of that required to release the brake 206 thereby opening pressure relief valve 218 while maintaining the brake 206 released. The flow of high pressure fluid will then pass through the relief valve 218 and will return to the sump S through line 220.

When the live mast 54 reaches its operating position, the pendant anchor 68' (FIG. 15) moves into abutting contact with the pendant stop 66 thus compressing spring 170 and causing the switch actuating element 182 to open switch 180. With switch 180 open, solenoid 194 is de-energized thereby closing valve 196 preventing the flow of hydraulic fluid to hydraulic motor 204 and allowing the spring set brake 206 to hold the drum 64*a* and 64*b* from rotation thus maintaining tension on pendant take-up lines 62*a*'' and 62*b*''.

From the foregoing description it is apparent that an improved pendant supported boom is provided which includes hydraulic cylinders to extend and retract the boom. The boom supported portion of the pendant is of fixed length and is trained around sheaves arranged within the boom to aid the cylinders when extending the boom thus permitting the use of smaller cylinders. Also a pendant take-up and payout system is disclosed for maintaining the pendants under tension at all times.

Although the best mode contemplated for carrying out the present invention has been herein shown and described, it will be apparent that modification and variation may be made without departing from what is regarded to be the subject matter of the invention.

What is claimed is:

1. A crane having a body and having an extensible boom, said boom having a base section pivotally connected to the body and having an intermediate boom section and a tip section, said boom sections mounted in telescopic relation, the improvement comprising a mast pivotally mounted on said boom, a pendant extending from the top of the mast to the end of the boom and into the boom for connecting to the base section, an intermediate sheave rotatably mounted in fixed relation to the intermediate section, an internal tip section sheave rotatably mounted in fixed relation to the tip section, two hydraulic cylinders recieved in said boom, one of said cylinders connected between the base section and the intermediate section, a cylinder sheave journaled on the forward end of said one cylinder, the other of said hydraulic cylinders being connected between the tip section and the intermediate section, said cylinders and a portion of said pendant trained around said sheaves cooperating to extend said boom sections and move said sheaves with respect to each other, the movement of said sheaves paying out pendant from the boom in response to extension of said boom sections to compensate for the change in length of the boom, said pendant portion within said boom being trained about said sheaves in a manner which assists said cylinders when extending said boom sections.

2. An apparatus according to claim 1, and additionally comprising a fourth section connected to the tip section.

3. A crane having a body and having an extensible boom, said boom having a base section pivotally connected to the body and having an intermediate boom section and a tip section, said boom sections mounted in telescopic relation: the improvement comprising a mast pivotally mounted on said boom; a pendant extending from the top of the mast to the end of the boom and into the boom for connection to the base section; an intermediate sheave rotatably mounted in fixed relation to the intermediate section; an internal tip section sheave rotatably mounted in fixed relation to the tip section; two hydraulic cylinders received in said boom; one of said cylinders connected between the base section and the intermediate section and the other of said hydraulic cylinders connected between the tip section and the intermediate section to extend said boom sections and move said sheaves with respect to each other, the movement of said sheaves paying out pendant from the boom in response to extension of said boom sections to compensate for the change in length of the boom; said base section including an outer end spaced from said connection to which said pendant is rigidly connected; pendant stop means secured to the mast and receiving said pendant; means defining a pendant anchor rigidly secured to said pendant and engaging said stop means when in boom supporting position; said pendant including a boom supporting portion of fixed length between said point of connection to said base section and said pendant anchor; a mast sheave journaled on the top of said mast; an external tip sheave journaled on the tip section of the boom externally of the telescoping sections; and a cylinder sheave journaled on said one cylinder adjacent its outer end; said pendant being trained around said mast sheave and said external tip sheave, and around said sheaves within said telescopic boom sections for applying an axial force in a direction which aids said hydraulic cylinders to extend said boom and to maintain said boom sections in the desired degree of extension when supporting a load.

4. An apparatus according to claim 3 wherein said pendant includes means defining a take-up line secured to said pendant anchor, and additionally comprising a pendant line take-up drum receiving said line, and means for rotating said drum in either direction to take up or payout line as required to maintain said pendant tensioned when said live mast is pivoted relative to said boom.

5. An apparatus according to claim 4 and additionally comprising power means for controlling pivotal movement of said live mast between a stowed position and a boom supporting position and for thereafter pivoting said boom between a horizontal transport position and said raised working position.

6. An apparatus according to claim 4 wherein said power means comprises a selectively driven boom hoist drum, and a boom hoist line trained around said drum and operatively connected to the upper end of said mast.

7. In a crane having a body; the combination of an elongated telescopic boom with a front and rear end having a base section pivotally connected to said body, an intermediate section, and a tip section; a live mast pivoted to said base section for movement between a stowed position lying substantially parallel to and on the upper surface of said boom, and a working position extending upwardly from said boom; a first hydraulic cylinder connected between said base section and said intermediate section for selectively expanding and retracting said intermediate section relative to said base section; a second hydraulic cylinder connected between said intermediate section and said tip section for selectively expanding and retracting said tip section relative to said intermediate section; a base section sheave journaled near the rear end of said base section; a cylinder sheave journaled near the forward end of said first cylinder; an intermediate section sheave journaled near the rear end of said intermediate section; a tip section sheave journaled near the forward portion of said tip section; means defining a pendant having a boom supporting portion of fixed length trained over said sheaves and having one end anchored to said base section and the other end anchored to said mast when said mast is in boom supporting position; and power means connected between the body and the upper end of said mast for pivoting said mast and pendant supported boom between a lowered transport position and a raised operative position; said pendant applying an axial force in a direction which aids said cylinders to extend said boom when said boom is in operative position.

8. An apparatus according to claim 7 and additionally comprising a power driven pendant hoist having a drum, said pendant means including a pendant take-up and payout portion connected to said fixed length portion and trained around said drum for maintaining said pendant under tension when said live mast is moving between said working and stowed positions, and means for rotating said drum to take-up pendant when said mast is being lowered to transport position and to payout pendant when said mast is being raised from transport position to said operative position.

9. An apparatus according to claim 8 wherein said pendant hoist is mounted on said live mast.

10. An apparatus according to claim 7 and additionally comprising a plurality of sheaves journaled on the upper end of said mast, and wherein said power means is a power driven hoist including a cable with one end anchored and an intermediate portion trained around one of said mast sheaves and said hoist.

11. An apparatus according to claims 7 or 9 and additionally comprising a plurality of mast sheaves journaled on the upper end of said mast, and wherein said power means is a power driven hoist having a cable with an end anchored to said body and an intermediate portion trained around one of said mast sheaves and said hoist, said pendant boom supporting portion being trained around one of said mast sheaves.

12. An apparatus according to claim 7 and additionally comprising tensioning means for maintaining said pendant means under tension when said mast is between said lowered transport position and said raised operative position.

13. An apparatus according to claim 12 wherein said tensioning means comprises: stop means rigidly secured to said mast, anchor means rigidly secured to said other end of said boom supporting portion of said pendant means and abutting said stop means when said mast is in operative position, resilient means normally urging said anchor means away from said stop means, a power driven pendant hoist having a drum, said pendant means including a pendant take-up and payout portion operatively connected to said anchor means and trained around said drum, and first switch means responsive to disengagement of said anchor means with said stop means for driving said drum in a pendant take-up direction when said mast is being lowered to its transport position.

14. An apparatus according to claim 13 and additionally comprising second switch means responsive to terminate driving of said pendant drum and to lock said drum in fixed position for maintaining tension on said pendant means when said mast is in its transport position.

15. An apparatus according to claims 13 or 14 and additionaly comprising brake means operatively connected to said drum for locking said drum from rotation when said mast is in said transport position and in said raised operative position, said brake being locked by spring means and being released to permit rotation of said drum when said mast is being moved between said transport and operative positions by hydraulic pressure of sufficient force to overcome said spring means.

* * * * *